United States Patent [19]

Sabatino

[11] 4,296,552

[45] Oct. 27, 1981

[54] CUTTING AND SPLITTING TOOL

[76] Inventor: David B. Sabatino, 253 N. California, Mundelein, Ill. 60060

[21] Appl. No.: 87,985

[22] Filed: Oct. 25, 1979

[51] Int. Cl.[3] ..... B26B 17/00

[52] U.S. Cl. ..... 30/183

[58] Field of Search ..... 30/180, 182, 183, 184, 30/185, 241, 242

[56] References Cited

U.S. PATENT DOCUMENTS

| | | | |
|---|---|---|---|
| 598,954 | 2/1898 | Noel | 30/185 X |
| 770,270 | 9/1904 | Dehn | 30/180 |
| 1,623,201 | 4/1927 | Owens | 30/187 |
| 2,414,149 | 1/1947 | Hall | 30/189 |
| 2,482,025 | 9/1949 | Persson | 30/187 X |
| 2,956,340 | 10/1960 | Levenson | 30/187 X |
| 2,999,610 | 9/1961 | Gapp | 30/183 X |
| 3,372,480 | 3/1968 | Rozmus | 30/180 X |
| 3,911,576 | 10/1975 | Castoe | 30/189 |

*Primary Examiner*—Jimmy C. Peters
*Attorney, Agent, or Firm*—Robert E. O'Neill

[57] ABSTRACT

An improved tool particularly suited for removing nuts and the like from a stud or similar retaining member. The tool includes a split housing having channels therein extending along perpendicular axes, and at least one cam follower pivotally mounted within the housing. A shaft is slidably positioned in one channel for linear movement along an axis. The shaft is threaded at one end and extends through the housing and has a rotating member coupled thereto which bears against the exterior of the housing. On the opposite end of the shaft a camming surface engages one end of the cam follower to cause movement of the follower in response to movement of the shaft. A cutting element is slidably positioned within a channel in the housing for linear movement along an axis perpendicular to the axis of the shaft. The cutting element is coupled to engage the opposite end of the cam follower for movement in response to movement of the follower. When the rotating member is turned, the shaft is linearly moved within the housing to cause pivotal movement of the follower and linear movement of the cutting element. By placing the cutting element adjacent the side of a nut and turning the rotating member, the cutting element may be forced to sever the nut for removal. Thereafter a socket, having extended inner surfaces, may be used to turn the nut for final removal.

19 Claims, 9 Drawing Figures

FIG. 1
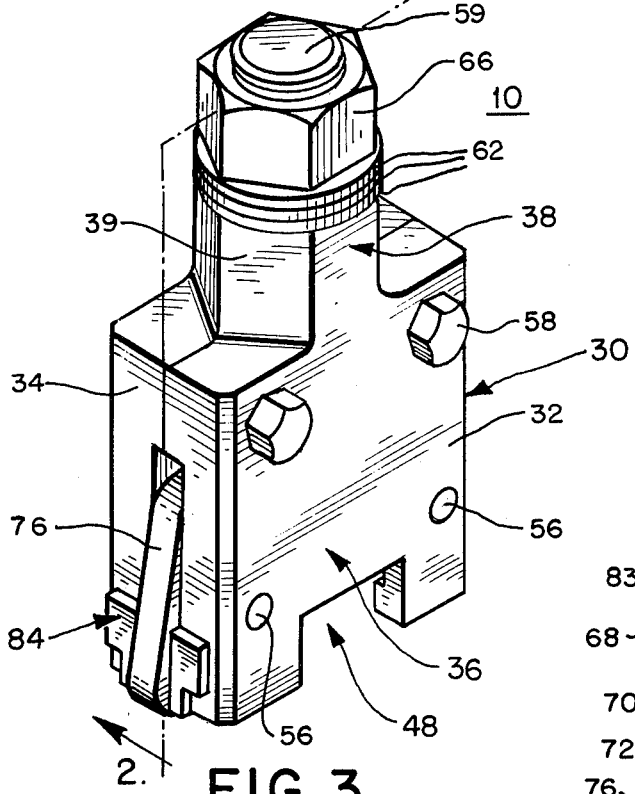
FIG. 2
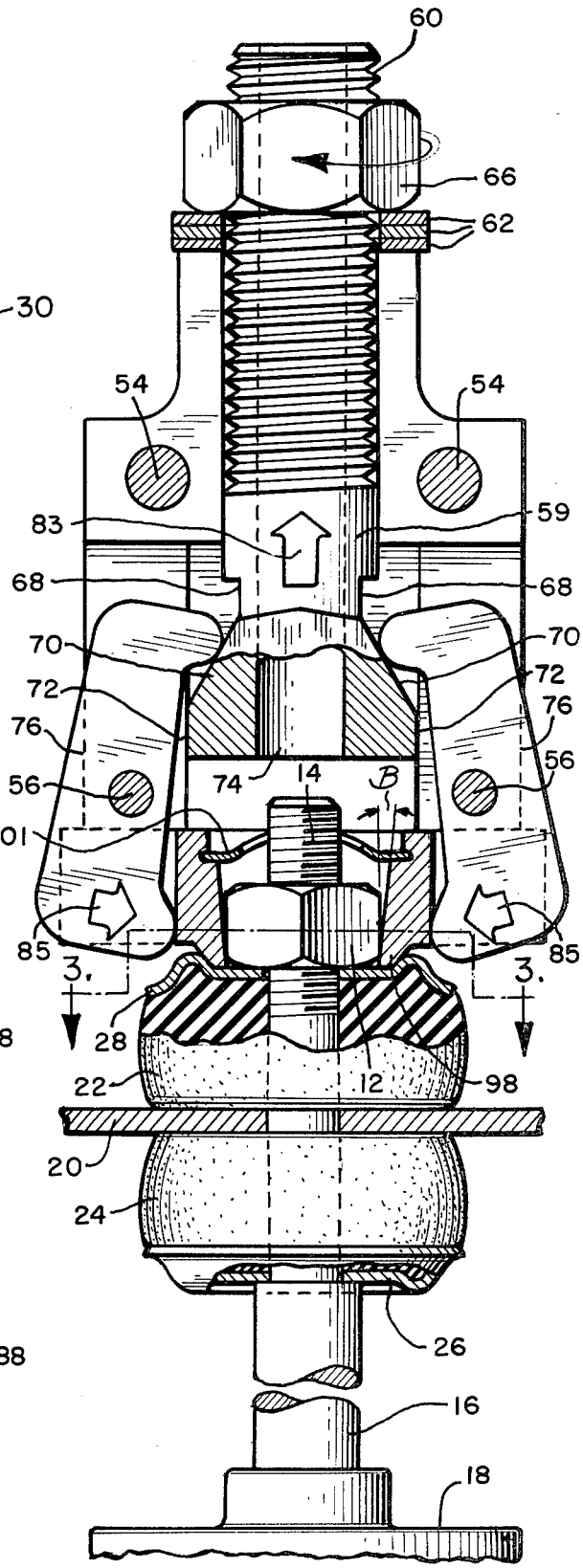
FIG. 3
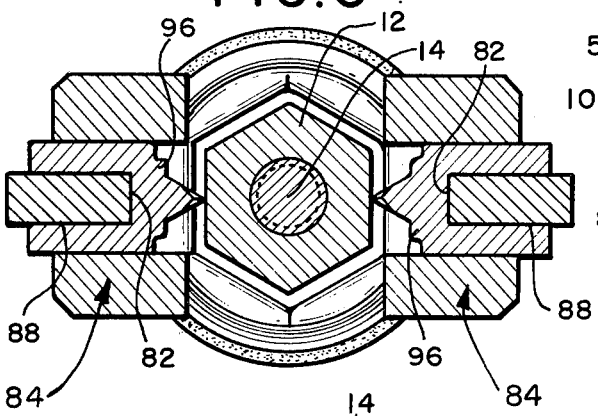
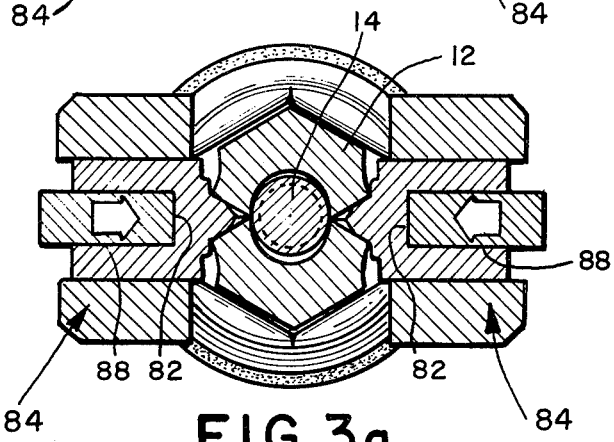
FIG. 3a

CUTTING AND SPLITTING TOOL

BACKGROUND OF THE INVENTION

The present invention relates to devices for removing or loosening fasteners and, more particularly, to improved tools for splitting and breaking nuts and the like.

In the prior art, a variety or problems are encountered in the removal of nuts from the ends of threaded shafts. In particular, in the maintenance and repair of automobiles, mechanics often have great difficulty in removing nuts which are frozen to the end of a threaded shaft due to rust or other corrosion. The problems of nut removal are additionally compounded by the fact that the nuts are often located in inaccessible areas or where space for tool use may be restricted. While a variety of tools have been proposed to facilitate the removal of such frozen nuts, each has been limited for use under special circumstances or conditions.

In one prior known technique for nut removal, the tools employ a splitting blade pivotally mounted within a housing and forced into cutting contact with a nut by the wedge action of a member moving within the housing. While such tools are capable of splitting nuts, a different tool must be used for each different size nut in order to provide proper cutting action without damaging the threads on the shaft from which the nut is being removed. In addition, such tools are incapable of accommodating studs or shafts beyond a certain length and are therefore restricted to use under special circumstances.

In another known technique for nut removal, the action of a camming surface is used to cause movement of two pivotally mounted cam followers, one of which has a cutting surface at one end and the other an anvil surface at one end. When the tool is applied to a nut, the cutting surface and anvil are placed on opposite sides of the nut and the cutting surface moved to sever the nut. However, in order for proper cutting to be achieved, and stud damage to be minimized, special adjustments must be made for each different size nut. Likewise, the tool cannot be used on nuts attached to studs or shafts beyond a certain length.

In still another prior known technique for nut removal, a pivotally mounted arm is used to force a nut into engagement with a cutting surface upon rotation of a bolt bearing against one end of the pivoted arm. While the tool provides for adjustment of the cutting surface in order to allow tool access to a nut from various positions, the tool configuration still requires substantial space for manipulation and operation.

Other numerous tools and techniques are known for nut removal but each is restricted to specific applications and is limited in effectiveness. Accordingly, the present invention has been developed to overcome the shortcomings of the above known and similar techniques and to provide an improved and inexpensive tool for splitting and severing nuts and the like.

SUMMARY OF THE INVENTION

In one embodiment of the invention, a housing is formed using two identical halves cooperating to provide channels extending along perpendicular axis within the housing. A first channel extends centrally through the housing along an axis which intersects the axis of two spaced-apart co-linear channels located at the lower end of the housing. A cutting element is slidably disposed within each of the spaced apart channels to provide opposed cutting surfaces adjacent the central channel. A shaft slidably disposed within the central channel is threaded at one end and formed to provide two camming surfaces at the opposite end. The threaded end of the shaft projects through the housing and a threaded rotating member is attached thereto external to the housing. A separate cam follower is pivotally mounted on opposite sides of the central channel and each follower has one end which engages one of the camming surfaces of the shaft and an opposite end which engages one of the cutting elements. In operation, as the rotating member is turned by a wrench or similar tool, the rotary motion is translated into linear movement of the shaft which, in turn, causes pivotal movement of the cam followers by contact with the camming surfaces on the shaft. The motion of the cam follower is then translated into a linear movement of the cutting elements in contact therewith. When the tool is positioned so that a nut is located between the opposed cutting surfaces of the cutting elements, movement of the rotating member in the proper direction will cause movement of the cutting surfaces toward one another and severing or splitting of the nut for easy removal. In addition, the shaft can have a bore therethrough to allow any stud on which the nut is secured to center the tool for effective splitting without stud damage.

In another embodiment of the invention, a similar split housing is used to retain a single cam follower and single cutting element in a manner similar to that previously described. A lower portion of the housing is then used to form an anvil surface against which the nut is positioned when the cutting element is forced into the nut by the action of the cam follower, shaft, and rotating member. In both embodiments, the linear movement of the cutting element provides effective splitting with less binding and wear, and with less damage to the stud or threaded shaft on which the nut is secured.

Once the nut has been split, it may still require a slight turn to loosen it from its frozen position. For this purpose a specifically modified socket may be used in accordance with the invention. The socket is formed by elongating the inner surfaces of a socket sized to fit the nut. The modified socket will then fit over a somewhat deformed nut to allow easy turning.

It is a feature of the present invention to provide a tool for splitting nuts and the like which is simple and versatile in operation and inexpensive in construction.

It is another feature of the invention to provide a tool for splitting nuts which provides linear movement of a cutting blade.

It is a further feature of the invention to provide a tool for splitting nuts which will provide centering of a cutting surface on the nut.

It is another feature of the invention to provide a tool for splitting nuts and the like which has a tapered cutting edge to prevent tool slippage during cutting.

It is still another feature of the invention to provide a tool for splitting nuts and the like in areas of limited access.

Yet another feature of the invention is to provide a tool which locates cutting edges substantially parallel to a stud or threaded shaft on which a nut may be retained.

Still another feature of the invention is to provide a tool that may be used to sever nuts retained on studs or shafts of indefinite length.

A still further feature of the invention is to provide a tool for splitting nuts even in recessed areas.

Yet another feature of the invention is to provide a tool for easy turning of a deformed split nut.

Other advantages and novel features of the invention will become apparent from the following detailed description when considered with the accompanying drawings wherein:

DESCRIPTION OF DRAWINGS

FIG. 1 is a perspective view of one embodiment of the cutting tool of the present invention.

FIG. 2 is a side sectional view taken along the line 2—2 in FIG. 1.

FIG. 3 is a cross sectional elevation view taken along the line 3—3 in FIG. 2 prior to nut splitting.

FIG. 3*a* is a cross sectional elevation view taken along the line 3—3 in FIG. 2 after nut splitting.

DETAILED DESCRIPTION OF THE PREFERRED EMBODIMENT

Figure 4:
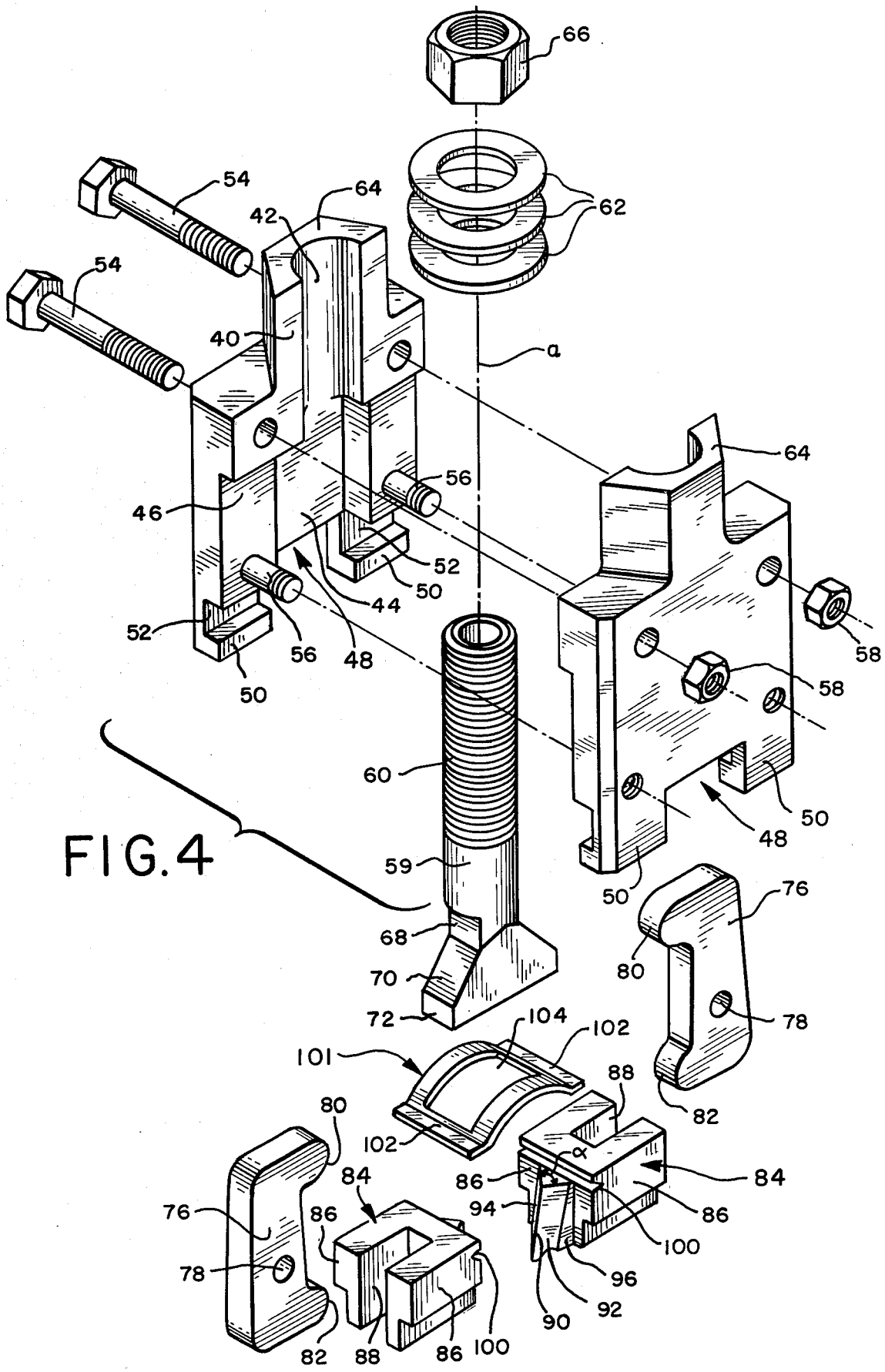
FIG. 4 is an exploded perspective view of the tool of FIG. 1.

Referring now to FIGS. 1, 2 and 4, there is shown a cutting tool 10 which can be used to split a fastener such as a nut for easy removal from a shaft, stud or other retaining element. Although not restricted to any specific applications, the tool is illustrated in FIG. 2 for use in splitting a nut 12 frozen on the threads of shaft 14. By way of example, the shaft 14 forms the end of a piston rod 16 which is part of an automobile shock absorber 18. The end of the shock absorber 18 is attached to the automobile frame or suspension structure 20 through upper grommet 22 and lower grommet 24. The rod 16 retains the washer 26 against the lower grommet 24. When the nut is tightened, force is applied to the washers 26 and 28 squeezing the grommets 22 and 24 against the element 20 to secure the end of the shock absorber to the automobile. As can be seen, the washer 28 is conventionally constructed to have a recessed configuration and the nut normally abuts against the washer in the recessed area.

As has been previously noted, it has been difficult to split nuts secured to shafts of this type when the end of the shaft extends significantly beyond the nut preventing insertion of the tool over the nut. Even when the shaft does not interfere with application of the tool to the nut, it is hard to locate the tool so that the cutting edge or edges engages the nut to provide efficient splitting. The problem is compounded since the nut is usually located in an area of limited space and restricted access which prevents the use of other nut removing tools. In addition, as illustrated in FIG. 2, the nut may be positioned in a recess against the washer so that cutting tools may not be able to engage the entire side of the nut for splitting.

These and other difficulties are overcome using the cutting tool and technique of the present invention. In one embodiment, the cutting tool 10 generally includes a housing 30 having two substantially identical halves 32 and 34. When assembled, the halves form a housing having a body portion 36 and a neck portion 38 having surfaces 39 constructed to form a hexagonal cross section. In this manner, a wrench or other tool can be used for engaging the neck 38 to restrain movement of the cutting tool during use if required. In the present example, each half is generally formed from a rectangular block having a projection 40 centrally extending from one edge to form one-half of the neck portion 38. Recess portions 42 and 44 are formed across the face of each block so that when the halves are assembled, a channel extends along an axis centrally through the neck and body portion of the housing. The recesses in each block are formed so that, in the present example, the central channel has a circular cross section in the neck and adjacent body portion and a rectangular cross section through the remainder of the body portion.

The surface of each block is further configured to form indented areas 46 on both sides of the recesses 42 and 44 and an opening 48 in the edge of the block adjacent the recess 44. The opening 48 forms a space in the block separating two leg portions 50 in which are formed recesses 52. Upon assembly, the recesses cooperate to form two separate co-linear channels spaced by opening 48 and, in the present example, having an axis which is perpendicular to the axis a of the central channel formed by recesses 42 and 44. The indented portions 46 of each half also cooperate upon assembly of the halves, to form rectangularly slotted openings which extend from each side of the housing into the central channel.

As illustrated in FIG. 2, the halves are secured to form the housing 30 by fasteners 54 and 56. Fasteners 54 are shown as bolts which extend through each block on opposite sides of the central channel to engage nuts 58. Fasteners 54 are shown as bolts which extend through one block half on opposite sides of the central channel and engage threaded holes in the other block half. Obviously, other fastening elements and techniques could be employed in any manner compatible with the operation of the tool.

Turning now to FIGS. 2 and 4, a shaft 59 is disposed for slidable movement in the central channel of the housing 30. The shaft is threaded along a portion 60 which extends through the neck 38 and projects from the housing. Washers 62 surround the threaded portion 60 and abut against the top surface 64 of the neck 38. A rotating member, nut 66, is threaded on the portion 60 of the shaft 59 and abuts against the washers 62.

The end of the shaft opposite to the threaded portion 60 is formed to have two flat surfaces 68 on opposite sides of the shaft 59 and extending substantially parallel to the shaft axis a. Below the flats 68, the shaft is formed to have symmetrical camming surfaces 70 which taper outwardly from 68 and terminate in flats 72 at the end of the shaft. A bore 74 extends through the length of the shaft 59 coaxial to the axis a to allow reception of the end of threaded shaft 14 as will be subsequently described. The end of the shaft 59 having surfaces 68, 70 and 72, slidably fits into that portion of the central channel formed by cooperating recesses 44. Thus in addition to guiding movement of the shaft 59, the channel formed by the recesses 44 prevents rotation of the shaft 59 when the nut 66 is turned during operation of the tool.

Two cam followers 76 are pivotally mounted through holes 78 to rotate about the bolts 56 extending through the housing 30. The cam followers are of identical shape and are symmetrically positioned on either side of the central channel. Each follower has one end with a surface 80 and an opposite end with a surface 82. The surface 80 of each follower engages the surfaces 68, 70 and 72 on the shaft 59. Upon movement of the shaft 59 in the direction indicated by the arrow 83, the followers are pivoted about the bolts 56 by the force of the camming surface 70 on the surface 80 causing the surfaces 82 to move toward one another in the direction indicated by the arrows 85. Naturally, upon reversal of the direction of movement of the shaft 59, the surfaces 82 will be allowed to move in opposite directions.

As shown best in FIG. 4, the cutting elements for the tool 10 are generally formed from rectangular blocks 84. Each block is symmetrically formed to have a shoulder 86 extending along the length of the block on opposite faces thereof. Each shoulder 86 if formed to slidably fit within a recess 52 to allow linear movement of the block in the channels formed by cooperating recesses 52. A generally rectangular slot 88 extends through another face of each block 84 and is designed to allow a portion of a cam follower 76 to be received therein so that surface 82 engages the block for movement (FIG. 3 and 3*a*).

The cutting surface of the element is formed on the face opposite to the slot 88. The cutting surface includes a knife-like edge 90 formed by the intersection of symmetrical flat surfaces 92 and 94. The surfaces may be machined or otherwise formed on the face of block 86. In accordance with the present invention, the surfaces are formed on a projecting shoulder 96 which extends across the height of the block 86. The shoulder acts to reduce the stress applied to the blocks during cutting. In addition, as can be seen with reference to FIG. 2, the cutting edge is formed so that a portion 98 extends below the bottom edge of the block 84. Also when the cutting tool is assembled, this portion 98 extends below all other portions of the cutting tool. This extension is provided to allow the cutting edge to engage more of the flat of a nut when the nut is located in a recessed area. Each block 84 additionally includes a slot extending horizontally across the top edge of the face of the block on which the cutting edge is located. The slot is formed to receive one edge 102 of a slotted rectangular spring element 101.

Turning now to FIG. 2, the cutting tool is shown in its operative assembled condition. As can be seen, the cutting elements 84 are positioned in the channels formed by recesses 52 and oriented so that the cutting edges extend into space 48 from opposite sides and are substantially equidistant from the axis a. The cam followers 76 engage the elements 84 in the slots 88 by the action of the spring element 101 having edges 102 engaged in slots 100 to force the elements 84 away from one another and against the surfaces 82. The force of the spring 101 transmitted through the cutting element 84 and follower 76 bias the surface 80 of each follower against the camming surfaces of the shaft 59. As was previously noted, the construction and positioning of the camming surfaces 68, 70 and 72; followers 76; and cutting elements 84 is selected to provide a symmetrical arrangement that results in cutting edges that are substantially equally spaced from the axis a and linearly moved an equal amount upon movement of the shaft 59. Additionally, in the present example, the cutting edges 90 are formed so that upon assembly a plane containing the line formed by axis a bisects the angle $\alpha$, formed by the intersection of the surfaces 92 and 94, on both cutting elements.

As is also shown in FIG. 2, an important feature of the invention also includes the formation of a tapered cutting edge to prevent slippage of the tool during cutting. The taper is formed so that the lowest point on the cutting edge is closer to the axis a than the upper most point on the cutting edge. In FIG. 2, this taper is shown as an angle B formed by the intersection of a line extending along the tool edge and a line parallel to the axis a. The vertex of the angle B is positioned at the lower most point on the cutting edge of the tool. This taper insures that the lower most position of the cutting edge first contacts the surface to be cut and prevents the tool from riding up on the nut when forces are applied to the cutting elements for movement. In the present example, the angle was selected to be 2° although the invention is not limited to only that angle.

During use of the cutting tool 10, the nut 66 is first turned to move shaft 59 in a direction opposite the arrow 83 so that the force of spring 101 is able to increase the distance between the opposed cutting surfaces 90 as follower surfaces 80 move toward flats 68. When there is sufficient space between the edges 90, the tool is inserted over the nut so that the edges 90 are positioned to engage the midpoint of opposite flats on the nut 12. If the threaded shaft 14 is of sufficient length, it will extend through slot 104 in spring 101 and into bore 74 of shaft 59 to center the cutting edges on the flats of the nut (FIG. 3). The nut 66 is then rotated to move the shaft in the direction of arrow 83. The cam surface 70 causes rotation of cam followers 76 which in turn cause linear movement of the cutting elements toward one another. The nut 66 is rotated until the cutting edges 90 split the nut 12 as shown in FIG. 3*a*. Since equal forces are being applied to both cutting elements by the symmetrical cam and follower arrangement, more reliable and uniform breakage is achieved. In addition, since the cutting elements are confined to the channels formed by the recesses 52 and only move linearly therein, the angle of each blade with respect to the surface being cut is substantially constant throughout the entire cutting process.

Figure 5:
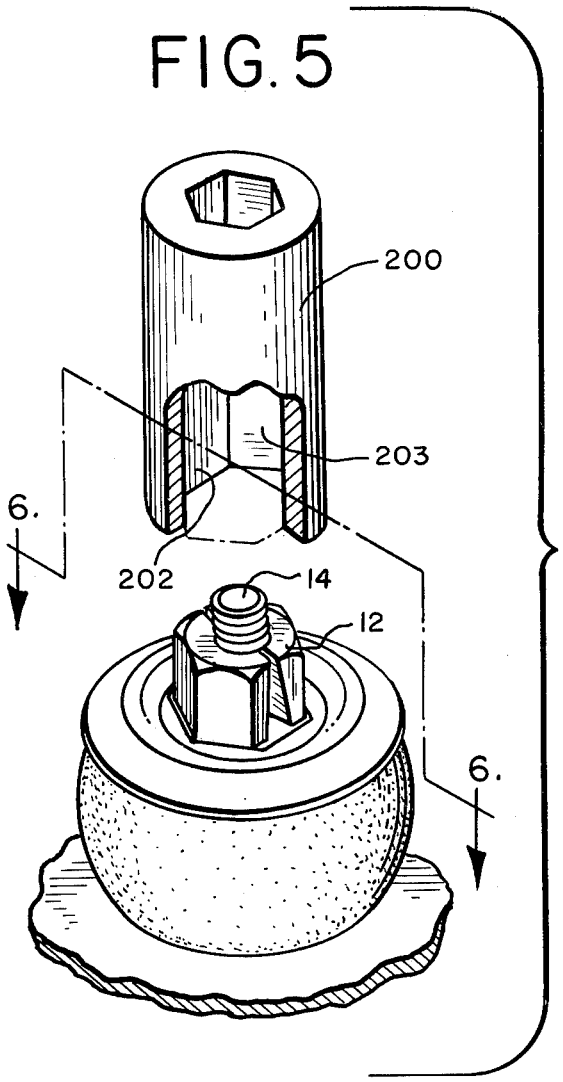
FIG. 5 is a perspective view of a modified socket for removal of a deformed nut.
Figure 6:
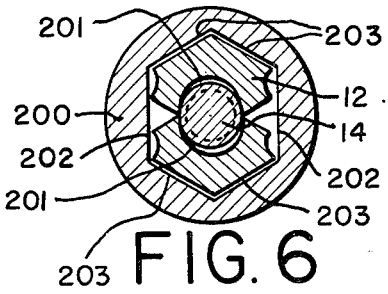
FIG. 6 is a cross sectional elevation view taken along the line 6—6 in FIG. 5.

Although the tool 10 will substantially sever a nut when used as described herein, it is sometimes necessary to apply a slight rotation to the severed nut to loosen it from its frozen position. Since the nut is somewhat deformed by the cutting action, a normal socket sized to the nut will not fit over the nut after splitting. According to the present invention, however, a modified socket can be applied to turn the nut after cutting. As shown in FIGS. 5 and 6, the cutting action of the tool forces the split halves of the nut away from the shaft 14, leaving spaces 201. This results in an elongation of the nut along opposing parallel sides. The modified socket 200 has an even number of inner nut-engaging surfaces forming pairs of opposed parallel surfaces 203. All surfaces 203 are of equal width and are formed to have the same dimension as would be necessary to engage the surfaces of a particular size nut prior to cutting. An additional pair of opposed parallel inner nut-engaging surfaces 202, however, which are normally identical to surfaces 203 in conventional sockets, are elongated (increased in width) by equal amounts thereby allowing the modified socket 200 to fit over the nut elongated by cutting. The modified socket may then be used to facilitate removal of all similarly sized nuts split by the tool 10.

As can be seen from the above description, the present invention provides various advantages over tools of the prior art. Generally, the tool is constructed to produce linear movement of the cutting edges. By providing linear movement of the blades, the angle of each edge relative to the surface being cut is maintained substantially constant throughout the cutting process. This allows more uniform and effective cutting than can be obtained with pivotally mounted blades of the prior art. In providing for such linear movement, the present configuration allows the splitting of nuts of various sizes without changing tools or tool components. The present tool also prevents slippage by tapering the cutting edge so that initial cutting contact with the surface being cut is made by the lower most portion of the cutting edge of the tool. In addition, by constructing the cutting element so that the cutting edge extends below all other portions of the cutting element and cutting tool, the cutting tool can effectively split nuts, even in recessed areas. Further, by employing a slidable shaft with a bore extending therethrough, the threaded shafts which retain a nut can be used to center the cutting tool while allowing splitting of nuts regardless of the shaft length. All of these are features not taught by the prior art.

Figure 7:
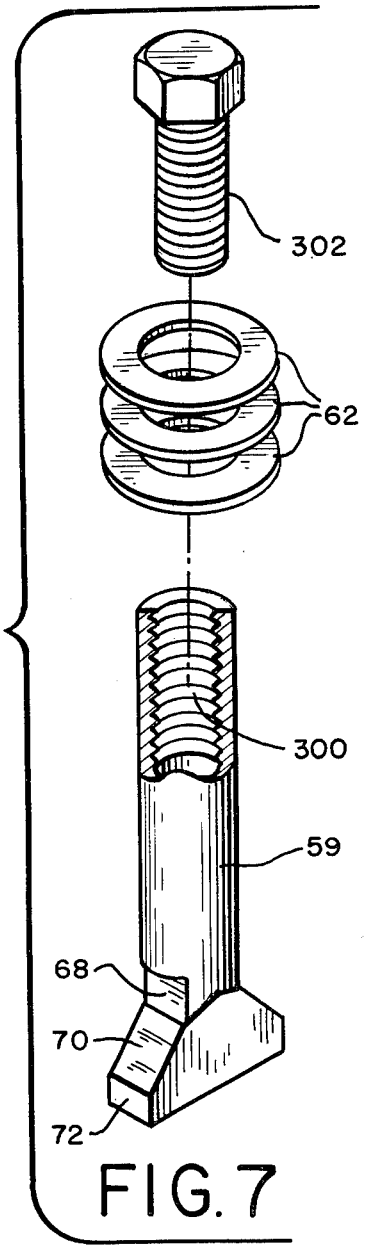
FIG. 7 is a perspective view of an alternative component for use in the tool of FIG. 1.

Although the invention has been described with reference to specific components and configurations, it is apparent that other components and arrangements could be used in accordance with the teachings of the invention. By way of example, as shown in FIG. 7, an internally threaded shaft could be used as an alternative to the shaft 59 of FIG. 2. More specifically, the shaft 59 could be internally threaded at 300 to receive a bolt 302 in lieu of nut 66. The rotation of bolt 302 would then cause movement of shaft 59. While bolt 302 would prevent the use of tool 10 to remove nuts on shafts beyond a certain length, all the other advantages of tool 10 would be retained.

In addition, although the shaft 59 is caused to move within the housing by the cooperation of threads 60 and nut 66, other configurations could be used to produce such movement. For example, the shaft 59 could be coupled to a hydraulically activated element or to a lever mechanism to produce the same linear movement of the shaft.

Figure 8:
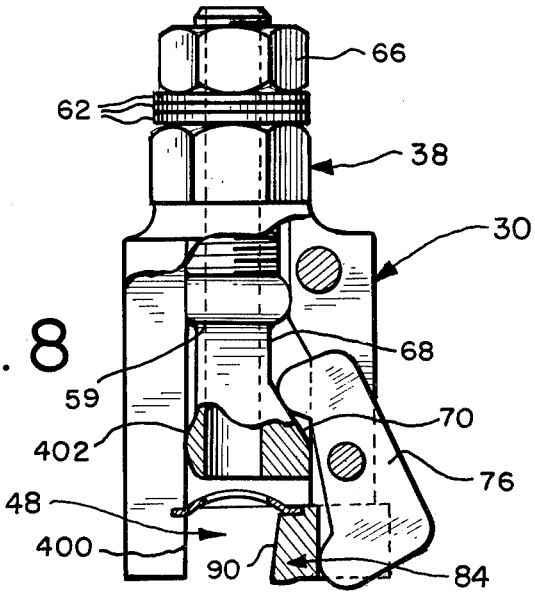
FIG. 8 is a side sectional view of an alternative embodiment of the invention.

FIG. 8 shows an alternative embodiment of the invention which employs only one cutting element and cam follower. Since the operation and construction of the device is similar to the embodiment of FIG. 1, only a brief description is necessary for an understanding of this embodiment. Briefly, the housing 30 is constructed so that only one cam follower is pivotally mounted to move in response to a single cam surface 70. Accordingly, only one cutting element 84 is positioned for linear movement in response to the cam follower. As an alternative to the second cutting element, a wall 400 of the housing is constructed to form an anvil surface positioned to engage the opposite flat of a nut to be split by the cutting element 84. In addition, the shaft 59 must be modified so that a portion 402 opposite the camming surface 70 is supported by the wall 400 of the housing. This support is needed to provide linear movement of the shaft 59 without binding during splitting of a nut. In all other respects the configuration and operation of the elements are similar to that described with reference to FIG. 1.

In both the embodiments of FIG. 1 and FIG. 8, it is an important feature of the invention that the cutting edge 90 of each cutting element is maintained substantially parallel to a plane which extends through and includes the line forming axis a and which is perpendicular to the direction of linear movement of each cutting element. In this regard, even though the cutting edge 90 is at a slight angle to the identified plane due to the slight taper previously noted, the cutting edge 90 is still considered to be substantially parallel to the identified plane. As a result of this orientation, the disclosed linear movement of a cutting element will cause all components of cutting force along each edge 90 to be applied in a direction substantially perpendicular to the identified plane.

While the materials forming the different components have not been specifically stated, it is apparent that any metal or other material having sufficient hardness and strength may be used to form the different components so long as the material enables the component to perform its function in the tool without substantial deformation or breakage. Obviously many other modifications and variations of the present invention are possible in light of the above teachings. It is therefore to be understood that within the scope of the appended claims the invention may be practiced otherwise than as specifically described.

I claim:

1. An improved cutting tool comprising:

a housing means having a first channel extending along an axis therethrough and at least one second channel substantially perpendicularly intersecting said first channel, said housing means being formed to have an opening at the intersection of said channels;

a shaft means slidably disposed for linear movement in said first channel, said shaft means including a first portion configured to have a tapered camming surface and a second portion;

cutting means slidably disposed for linear movement in said at least one second channel, said cutting means including a cutting edge movable into said opening from one side, said cutting edge being constructed and disposed so that it is substantially parallel to said axis during linear movement of said cutting means;

means coupled to said housing means for forming a surface on a side of said opening opposite to said one side;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening and towards said surface means.

2. The tool of claim 1 wherein said surface forming means comprises a surface of the housing means positioned on the side of said opening opposite to said cutting edge.

3. The tool of claim 1 wherein said cutting edge is linearly tapered so that a lower portion of said cutting edge is closer to said axis than an upper portion of said cutting edge.

4. An improved cutting tool comprising:

a housing means having a first channel extending along an axis therethrough and at least one second channel intersecting said first channel, said housing means being formed to have an opening at the intersection of said channels;

a shaft means slidably disposed for linear movement in said first channel, said shaft means including a first portion configured to have a tapered camming surface and a second portion;

cutting means slidably disposed for linear movement in said at least one second channel, said cutting means including a cutting edge movable into said opening from one side, said cutting edge being constructed to have a lower edge portion which extends below any other portion of the tool;

means coupled to said housing means for forming a surface on a side of said opening opposite to said one side;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening and towards said surface means.

5. In a nut cutting system including a cutting tool having at least one cutting edge disposed adjacent a nut retained on an elongated shaft and operated to cause said cutting edge to split said nut, the improvement in said cutting tool comprising:

a housing means having a first channel extending along an axis therethrough and at least one second channel substantially perpendicularly intersecting said first channel, said housing means being formed to have an opening for receiving the nut at the intersection of said channels;

a shaft means slidably disposed for linear movement in said first channel, said shaft means including a first portion configured to have a tapered camming surface and a second portion;

cutting means slidably disposed for linear movement in said at least one second channel, said cutting means including a cutting edge movable into said opening from one side to engage a surface of the nut positioned in the opening, said cutting edge being constructed and positioned to be substantially parallel to the axis of the elongated shaft during cutting;

means coupled to said housing means for forming a surface on a side of said opening opposite to said one side which engages another side of the nut;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening against said nut surface to split the nut;

said nut being located in a recess and said cutting edge being formed to have a portion which extends into the recess below all other portions of the cutting tool to engage the surface of the nut in the recess.

6. An improved cutting tool comprising:

a housing means having a first channel extending along an axis therethrough and at least one second channel intersecting said first channel, said housing means being formed to have an opening at the intersection of said channels;

a shaft means slidably disposed for linear movement in said first channel, said shaft means including a first portion configured to have a tapered camming surface and a second portion, and a bore extending entirely through said shaft means coaxial to said axis;

cutting means slidably disposed for linear movement in said at least one second channel, said cutting means including a cutting edge movable into said opening from one side;

means coupled to said housing means for forming a surface on a side of said opening opposite to said one side;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening and towards said surface means.

7. The tool of claim 6 further including a spring means for biasing said cutting means in a direction opposite to the direction of movement caused by the movement of said shaft means in said one direction.

8. The tool of claim 6 wherein said second portion of said shaft means is constructed to extend external to said housing means and is externally threaded, and further wherein said means for causing linear movement of said shaft means comprises a rotating member threaded onto said second portion externally of said housing.

9. The tool of claim 6 wherein said bore extends through said second portion of said shaft means and is threaded in said second portion and further wherein said means for causing linear movement of said shaft means comprises a rotating member threaded into said bore from the exterior of the housing means.

10. The tool of claim 1 wherein an upper portion of said housing means has a reduced neck portion and said first channel extends through said neck portion, said neck portion being configured to receive a wrench or other restraining tool thereon.

11. An improved tool comprising:

a housing having a first channel extending along an axis therethrough and second and third co-linear channels symmetrically spaced on opposite sides of said first channel at a lower end of said housing and substantially perpendicularly intersecting said first channel, said housing being formed to provide an opening between said second and third channels;

a shaft slidably disposed for linear movement in said first channel, said shaft including a first portion configured to have tapered cam surfaces located on opposite sides thereof and symmetrical with the axis and a second portion;

a cutting element slidably disposed in each of said second and third channels, each of said cutting elements including a cutting edge movable into said opening from opposite sides and symmetrically positioned substantially equidistant from said axis;

a cam follower pivotally mounted on opposite sides of said axis and symmetrical thereto, each of said cam followers having a first surface for engaging one of said camming surfaces and a second surface for engaging one of said cutting elements;

means coupled to said first portion of said shaft for causing linear movement of said shaft and corresponding movement of said camming surfaces;

each camming surface being coupled to rotate its respective cam follower upon movement of the shaft in one direction so as to cause linear movement of the associated cutting element in said second and third channels and corresponding linear movement of the cutting edges toward one another in said opening;

said cutting edges being constructed to be substantially parallel to said axis and substantially parallel to each other during linear movement of said cutting elements.

12. The tool of claim 11 further including a bore extending entirely through said shaft coaxial to said axis.

13. The tool of claim 11 wherein each cutting edge is linearly tapered so that a lower portion of each cutting edge is closer to said axis than an upper portion of each edge.

14. The tool of claim 11 wherein each of said cutting elements are of substantially identical construction and each cutting edge is constructed to have a lower portion which extends below all other portions of the cutting element and tool.

15. The tool of claim 11 further including a spring means biasing said cutting elements against movement toward each other.

16. The tool of claim 15 wherein said spring means is a slotted spring extending between the cutting elements and positioned so that the slot in the spring is coaxial to said axis.

17. In a nut cutting system including a cutting tool having at least one cutting edge disposed adjacent a nut retained on an elongated shaft and operated to cause said cutting edge to split said nut, the improvement in said cutting tool comprising:

a housing means having a first channel extending along an axis therethrough and at least one second channel substantially perpendicularly intersecting said first channel, said housing means being formed to have an opening for receiving the nut at the intersection of said channels;

a shaft means slidably disposed for linear movement in said first channel, said shaft means including a first portion configured to have a tapered camming surface and a second portion;

cutting means slidably disposed for linear movement in said at least one second channel, said cutting means including a cutting edge movable into said opening from one side to engage a surface of the nut positioned in the opening, said cutting edge being constructed and positioned to be substantially parallel to the axis of the elongated shaft during cutting;

means coupled to said housing means for forming a surface on a side of said opening opposite to said one side which engages another side of the nut;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening against said nut surface to split the nut.

18. The system of claim 17 wherein said shaft means includes a bore therethrough coaxial to said axis and wherein a portion of the elongated shaft which extends beyond the nut is received by said bore to locate the cutting edge relative to the nut.

19. In a nut cutting system including a cutting tool having at least one cutting edge disposed adjacent a nut retained on an elongated shaft and operated to cause said cutting edge to split said nut, the improvement in said cutting tool comprising:

a housing means having a first channel extending along an axis therethrough and at least one second channel substantially perpendicularly intersecting said first channel, said housing means being formed to have an opening for receiving the nut at the intersection of said channels;

a shaft means slidably disposed for linear movement in said first channel, said shaft means including a first portion configured to have a tapered camming surface and a second portion;

cutting means slidably disposed for linear movement in said at least one second channel, said cutting means including a cutting edge movable into said opening from one side to engage a surface of the nut positioned in the opening, said cutting edge being constructed and positioned to be substantially parallel to the axis of the elongated shaft during cutting;

cutting means slidably disposed for linear movement in said at least one second channel, said cutting means including a cutting edge movable into said opening from one side to engage a surface of the nut positioned in the opening;

means coupled to said housing means for forming a surface on a side of said opening opposite to said one side which engages another side of the nut;

cam follower means pivotally mounted in said housing means and having a first surface for engaging said camming surface and a second surface for engaging said cutting means; and means coupled to said second portion of said shaft means for causing linear movement of said shaft means and corresponding movement of said camming surface;

said camming surface being coupled to rotate said cam follower means upon movement of the shaft means in one direction to cause linear movement of said cutting means in said at least one second channel and corresponding linear movement of said cutting edge in said opening against said nut surface to split the nut;

said cutting edge being tapered so that a lower portion of the cutting edge contacts the nut before any other portion of the cutting edge.

* * * * *